US011420352B2

(12) United States Patent
Kopelas et al.

(10) Patent No.: US 11,420,352 B2
(45) Date of Patent: Aug. 23, 2022

(54) SHAVING DEVICE COMPRISING AN AUTOTIGHTENING SPRING DEVICE FOR ASSEMBLING A REMOVABLE CARTRIDGE WITH AN HANDLE

(71) Applicant: BIC VIOLEX S.A., Anoixi (GR)

(72) Inventors: Panagiotis Kopelas, Anoixi (GR); Sam Pearce, Nottinghamshire (GB)

(73) Assignee: BIC Violex Single Member S.A., Anoixi (GR)

( * ) Notice: Subject to any disclaimer, the term of this patent is extended or adjusted under 35 U.S.C. 154(b) by 23 days.

(21) Appl. No.: 17/071,335

(22) Filed: Oct. 15, 2020

(65) Prior Publication Data

US 2021/0129365 A1 May 6, 2021

(30) Foreign Application Priority Data

Oct. 30, 2019 (EP) ..... 19206186

(51) Int. Cl.
*B26B 21/52* (2006.01)
*B26B 21/40* (2006.01)
*B26B 21/14* (2006.01)

(52) U.S. Cl.
CPC ..... *B26B 21/521* (2013.01); *B26B 21/14* (2013.01); *B26B 21/4062* (2013.01)

(58) Field of Classification Search
None
See application file for complete search history.

(56) References Cited

U.S. PATENT DOCUMENTS 6,421,925 B1 * 7/2002 Wonderley ..... B26B 21/4062 30/532
8,079,147 B2 * 12/2011 Wonderley ..... B26B 21/528 30/47
9,327,415 B1 5/2016 Hovsepian
(Continued)

FOREIGN PATENT DOCUMENTS

EP 3378610 A1 9/2018
EP 3623121 A1 3/2020
(Continued)

OTHER PUBLICATIONS

European Search Report in corresponding Application No. EP 19206186.9 dated Apr. 17, 2020. (7 pages).

*Primary Examiner* — Hwei-Siu C Payer
(74) *Attorney, Agent, or Firm* — Bookoff McAndrews, PLLC

(57) ABSTRACT

A shaving device comprising a handle and a removable cartridge, the handle comprising a gripping portion extending along an axis and a first coupling portion arranged at an axial end of the gripping portion, the removable cartridge comprising a shaving head and a second coupling portion, the first coupling portion and the second coupling portion being configured to be removably coupled together for assembling the removable cartridge with the handle, a first element among the first coupling portion and the second coupling portion comprising an auto-tightening spring device configured to lock a second element among the first coupling portion and the second coupling portion with the first element when the second coupling portion is moved axially toward the gripping portion and cooperates with the first coupling portion.

20 Claims, 4 Drawing Sheets

(56) References Cited

U.S. PATENT DOCUMENTS

| | | | | |
|---|---|---|---|---|
| 2018/0264667 | A1 | 9/2018 | Chang et al. | |
| 2018/0272549 | A1* | 9/2018 | Son | B26B 21/225 |
| 2019/0176355 | A1* | 6/2019 | Mazarakis | B26B 21/521 |
| 2021/0129365 | A1* | 5/2021 | Kopelas | B26B 21/521 |
| 2021/0187769 | A1* | 6/2021 | Kopelas | B26B 21/521 |

FOREIGN PATENT DOCUMENTS

| | | | |
|---|---|---|---|
| WO | 2009108855 | A2 | 9/2009 |
| WO | 2018007844 | A1 | 1/2018 |

* cited by examiner

SHAVING DEVICE COMPRISING AN AUTOTIGHTENING SPRING DEVICE FOR ASSEMBLING A REMOVABLE CARTRIDGE WITH AN HANDLE

This application claims benefit from European patent application EP19206186.9, filed on 30 Oct. 2019, its content being incorporated herein by reference.

TECHNICAL FIELD

The present disclosure relates to a shaving device having a handle and a removable cartridge.

BACKGROUND

Traditional shaving devices having a handle and a removable cartridge are provided with a coupling mechanism for assembling the cartridge with the handle. However, such coupling mechanisms usually have many different parts, rendering their assembly process during manufacturing complex and expensive. Therefore, a need exists to provide a shaving device having a coupling mechanism simpler to assemble during manufacturing.

SUMMARY

In embodiments, a shaving device comprises a handle and a removable cartridge, the handle comprising a gripping portion extending along an axis and a first coupling portion arranged at an axial end of the gripping portion, the removable cartridge comprising a shaving head and a second coupling portion, the first coupling portion and the second coupling portion being configured to be removably coupled together for assembling the removable cartridge with the handle, a first element among the first coupling portion and the second coupling portion comprising an auto-tightening spring device configured to at least partially deform to lock a second element among the first coupling portion and the second coupling portion with the first element when the second coupling portion is moved axially toward the gripping portion and cooperates with the first coupling portion The first coupling portion and the second coupling portion form together a coupling mechanism.

The more the auto-tightening spring device is actuated, the more the locking effect acts.

Such an auto-tightening spring device may comprise less parts than traditional coupling mechanisms for shaving device and may be easier to assemble during manufacturing.

In embodiments, the auto-tightening spring device may comprise a part configured to expand and to engage with at least one recess of the second element when the second coupling portion is moved axially toward the gripping portion and cooperates with the first coupling portion.

In the following, unless otherwise specified, "the recess" should be understood as "the at least one recess".

The part (or expandable part) may be a spring or a spring portion, but not necessarily.

In embodiments, the auto-tightening spring device may comprise an annular spring configured to radially deform when the second coupling portion is moved axially toward the gripping portion and cooperates with the first coupling portion.

The annular spring may be the expandable part described above. The annular spring may form a continuous closed loop of material. The annular spring may have any annular shape, for example when relaxed, for example a ring shape, an oval shape, an elliptical shape, etc. the shape being regular or not.

The annular spring may extend in a plane. In the following, unless otherwise specified, "radially deformed" should be understood as the annular spring is deformed by compression or traction oriented radially and parallel to the plane.

In embodiments, the annular spring may be configured to adopt a relaxed configuration and a compressed configuration, the annular spring having an annular shape having a first maximum length parallel to the axis and a second maximum length perpendicular to axis and extending in a plane parallel the annular shape, the first maximum length in the relaxed configuration being greater than the first maximum length in the compressed configuration while the second maximum length in the relaxed configuration is smaller than the second maximum length in the compressed configuration.

The annular spring may have a configuration wherein the first maximum length and the second maximum length are equal, for example a configuration wherein the annular shape is a circle, but not necessarily.

The second length direction may define the expansion direction of the annular spring.

In embodiments, the annular spring may comprise at least one protrusion configured to engage within the at least one recess of the second element.

In the following, unless otherwise specified, "the protrusion" should be understood as "the at least one protrusion".

For example, the annular spring may comprise two protrusions diametrically opposed. For example, a geometric line joining the two protrusions may be perpendicular to the axis. The two protrusions may protrude radially outwardly from the annular spring.

In embodiments, the annular spring may be coupled with a pusher, the pusher being configured to cooperate with the second element, to move axially and to compress radially the annular spring when the second coupling portion is moved axially toward the gripping portion and cooperates with the first coupling portion.

The pusher may form an interface of the first element configured to be actuated by the second element when the second coupling portion is moved axially toward the gripping portion and cooperates with the first coupling portion.

In embodiments, when the removable cartridge is assembled with the handle, the pusher may be configured to cooperate with the shaving head in order to provide a return force opposite to a movement of the shaving head.

The shaving head may be mounted movable onto the second coupling portion. For example, the shaving head may rotate with regard to the second coupling portion. The pusher may form a finger configured to be pressed by the shaving head when moved from a rest position toward the pusher, and to provide a return force in order to move back the shaving head toward its rest position.

In embodiments, the pusher and the annular spring may be integrally formed as a mono-block component.

In embodiments, the auto-tightening spring device may comprise a backstop mechanism configured to lock the auto-tightening spring device in a locking configuration when the second coupling portion has passed a predetermined axial position with regard to the first coupling portion.

In other words, the backstop mechanism is configured to lock the auto-tightening spring device in a configuration wherein the first coupling portion and the second coupling portion are locked together.

For example, the predetermined axial position may correspond to a position wherein the first and second elements cooperate so that the auto-tightening spring device locks the second element with regard to the first element. According to another example, the predetermined axial position may correspond to a position wherein the expandable part of the auto-tightening spring device expands and is engaged with the recess of the second element. According to still another example, the predetermined axial position may correspond to a position wherein the annular spring is radially deformed and/or in the compressed configuration. For example, the predetermined position may be defined as an axial distance between a first reference point, for example a first shoulder, of the first coupling portion and a second reference point, for example a second shoulder, of the second coupling portion. For example, the predetermined position may be comprised between 0.0 mm and 2.0 mm along the axis from the first reference point.

In embodiments, the backstop mechanism may comprise a hook configured to move axially when the annular spring is radially deformed and to engage with a complementary stop when the second coupling portion has passed the predetermined axial position.

The hook may have any shape, and is configured to cooperate with the complementary stop so as to be able to engage/disengage with each other and to maintain/release the auto-tightening spring device in/from the locking configuration, i.e. a configuration wherein the backstop mechanism lock the auto-tightening spring device in a configuration wherein the first element and the second element are locked together.

In embodiments, the hook may comprise an axial rod, the axial rod being coupled with two diametrically opposed areas disposed respectively on both sides of the axis, via two arms.

For example, a geometric line joining the two areas may be perpendicular to the axis. For example, the areas may be at the same place than, or in the neighbourhood of, the two protrusions, but not necessarily.

In embodiments, the backstop mechanism and the annular spring may be integrally formed as a mono-block component.

In embodiments, the auto-tightening spring device may comprise a button configured to release the backstop mechanism, when actuated.

In other words, the actuation of the button releases the backstop mechanism which then unlocks the auto-tightening spring device. For example, when actuating the button, the annular spring may pass from the compressed configuration to the relaxed configuration.

In embodiments, the button may be configured to cooperate with the hook.

The button may comprise the complementary stop.

In embodiments, the auto-tightening spring device may be arranged within a housing of the first coupling portion.

Such shaving devices may comprise a very limited number of parts and may be very easy to assemble during manufacturing.

BRIEF DESCRIPTION OF THE DRAWINGS

The disclosure and its advantages can be better understood by reading the detailed description of various embodiments given as non-limiting examples. The description refers to the accompanying sheets of figures, in which.

DETAILED DESCRIPTION

Figure 1A:
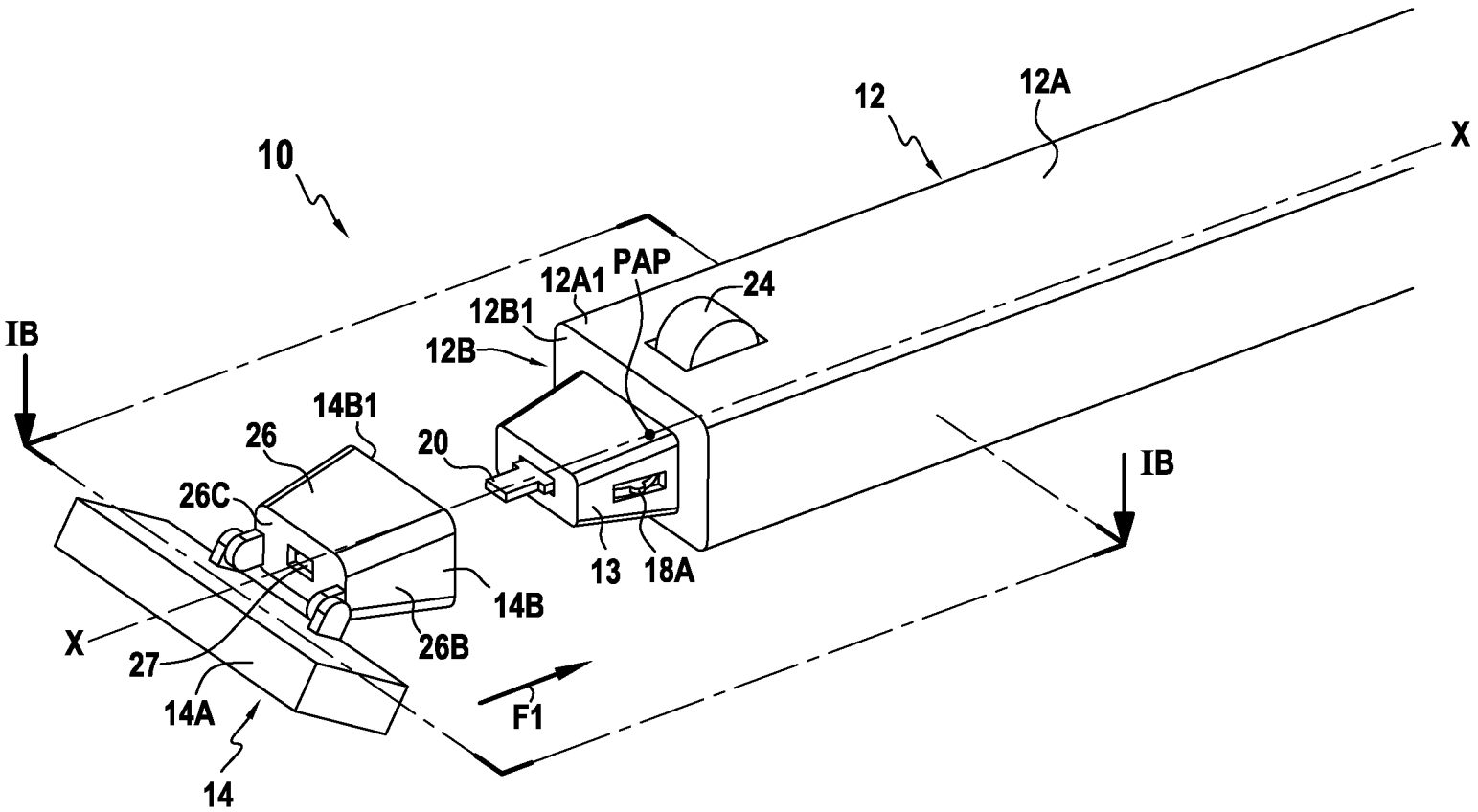
FIG. 1A shows a shaving device wherein the removable cartridge is separated from the handle.

An embodiment of a shaving device 10 is described with reference to FIGS. 1A, 1B, 2A and 2B. The shaving device 10 comprises a handle 12 and a removable cartridge 14. The handle 12 comprises a gripping portion 12A and a first coupling portion 12B arranged at a distal axial end 12A1 of the gripping portion 12A. The gripping portion extends along an axis X. The cartridge 14 comprises a shaving head 14A and a second coupling portion 14B. The first coupling portion 12B and the second coupling portion 14B are configured to be removably coupled together for assembling/disassembling the cartridge 14 with/from the handle 12, and form a coupling mechanism.

The first coupling portion 12B may comprise an auto-tightening spring device 16 configured to at least partially deform to lock the second coupling portion 14B with the first coupling portion 12B when the second coupling portion 14B is moved axially (i.e. along the axis X) toward the gripping portion 12A and cooperates with the first coupling portion 12B. In the present example, the first coupling portion 12B and the second coupling portion 14B may cooperate together by engagement, but other types of cooperation may be foreseen. The auto-tightening spring device 16 may be partly arranged within a casing 13 of the first coupling portion 12B, while some parts of the auto-tightening spring device 16 described hereafter may protrude from the casing 13.

The auto-tightening spring device 16 may comprise a deformable part (or expandable part), in this example an annular spring 18, which is configured to expand and to engage with two recesses 19 of the second coupling portion 14B when the second coupling portion 14B is moved axially toward the gripping portion 12A and cooperates with the first coupling portion 12B. In alternative embodiments, other number of recesses may be foreseen, for example a single recess, or more than two recesses, for example four recesses.

The annular spring 18 may have an annular shape, in the present example an oval shape. The greatest (radial) axis A1 of the oval shape may be disposed so as to be perpendicular to the axis X. In other words, the smallest (radial) axis A2 of the oval shape may be parallel to the axis X. The annular spring 18 may be configured to radially deform when the second coupling portion 14B is moved axially toward the gripping portion 12A and cooperates with the first coupling portion 12B. The annular spring 18 may comprise two diametrically opposed protrusions 18A protruding radially outwardly and configured to respectively engage within the recesses 19. The protrusions 18A may be disposed on both sides of the axis X, along a geometric line which is perpendicular to the axis X. In the present example, the protrusions 18A may be disposed along the greatest axis A1. In alternative embodiments, the annular spring 18 may be provided with one protrusion on one side and one recess on the other side, respectively configured to engage with a recess and a protrusion of the second coupling member 14B.

A pusher 20 may be coupled with the annular spring 18. The pusher 20 may be integrally formed as a mono-block component with the annular spring 18. The pusher 20 may be formed by a projection projecting along the axis X from the oval shape of the annular spring 18 toward the cartridge 14. In a variant, the pusher may form a distinct and separated part from the annular spring.

The pusher 20 may comprise a first abutment 20A and a second abutment 20B. The second abutment 20B may be closer to the shaving head 14A that the first abutment 20A. The first abutment 20A may be configured to cooperate axially with the second coupling portion 14B while the second abutment 20B may be configured to cooperate axially with the shaving head 14A.

The auto-tightening spring device 16 may comprise a backstop mechanism 22 configured to lock the auto-tightening spring device 16 in a locking configuration when the second coupling portion 14B has passed a predetermined axial position PAP with regard to the first coupling portion 12B. In this example, the predetermined axial position PAP is placed on the axis X at approximately 0.5 mm from a first shoulder 12B1 of the first coupling portion 12B. It may be considered that the second coupling portion 14B has passed the predetermined axial position PAP when a second shoulder 14B1 of the second coupling portion 14B is axially distant of approximately 0.5 mm or less from the first shoulder 1261.

The backstop mechanism 22 may comprise a hook 22A configured to move axially when the annular spring 18 is radially deformed and to engage with a complementary stop (not shown) when the second coupling portion 14B has passed the predetermined axial position PAP. The hook 22A may comprise an axial rod 22B, the axial rod 22B being coupled with two diametrically opposed areas 18B disposed respectively on both sides of the axis X, via two arms 21. The arms 21 may be hinged arms. The hook 22A and the rod 22B may be received, at least in part, in a hollow path 11 extending axially within the gripping portion 12A. The areas 18B may be inner positions of the annular spring 18 corresponding to the protrusions 18A, the protrusions 18A protruding radially outwardly with regard to the annular shape of the annular spring 18. The hook 22A and the axial rod 22B may be integrally formed as a mono-block component. The axial rod 22B and the arms 21 may be integrally formed as a mono-block component. The arms 21 and the annular spring 18 may be integrally formed as a mono-block component. The backstop mechanism 22 may be integrally formed as a mono-block component with the annular spring 18. In a variant, the hook 22A and/or the axial rod 22B and/or the arms 21 and/or the annular spring 18 may form distinct parts. For example, the annular spring 18, the pusher 20 and the backstop mechanism 22 may be integrally formed as a mono-block component. In a variant, the annular spring 18 and/or the pusher 20 and/or the backstop mechanism 22 may form distinct parts. For example, the annular spring 18 and/or the pusher 20 and/or the backstop mechanism 22 may be made of plastic, in a manner well known by the skilled person.

The auto-tightening spring device 16 may comprise a button 24 configured to release the backstop mechanism 22, when actuated. The button 24 may be configured to cooperate with the hook 22A. The button 24 may comprises the complementary stop which is not shown. Such a button 24 comprising the complementary stop configured to cooperate with a hook is well known by the skilled person.

The second coupling portion 14B may form a sheath 26 configured to receive the first coupling portion 12B. The first coupling portion 12B may form a male portion while the second coupling portion 14B may form a female portion. The sheath 26 may comprise an aperture 26A through which the first coupling portion 12B may pass in order to cooperate with the second coupling portion 14B. The sheath 26 may comprise a lateral wall 26B extending axially and in which the recesses 19 are arranged. The sheath 26 may comprise a transverse wall 26C provided with a through hole 27. The transverse wall 26C may form a complementary abutment configured to cooperate with the first abutment 20A of the pusher 20. The second abutment 20B may pass through the through hole 27 in order to face a rear face 14A1 of the shaving head 14.

Figure 1B:
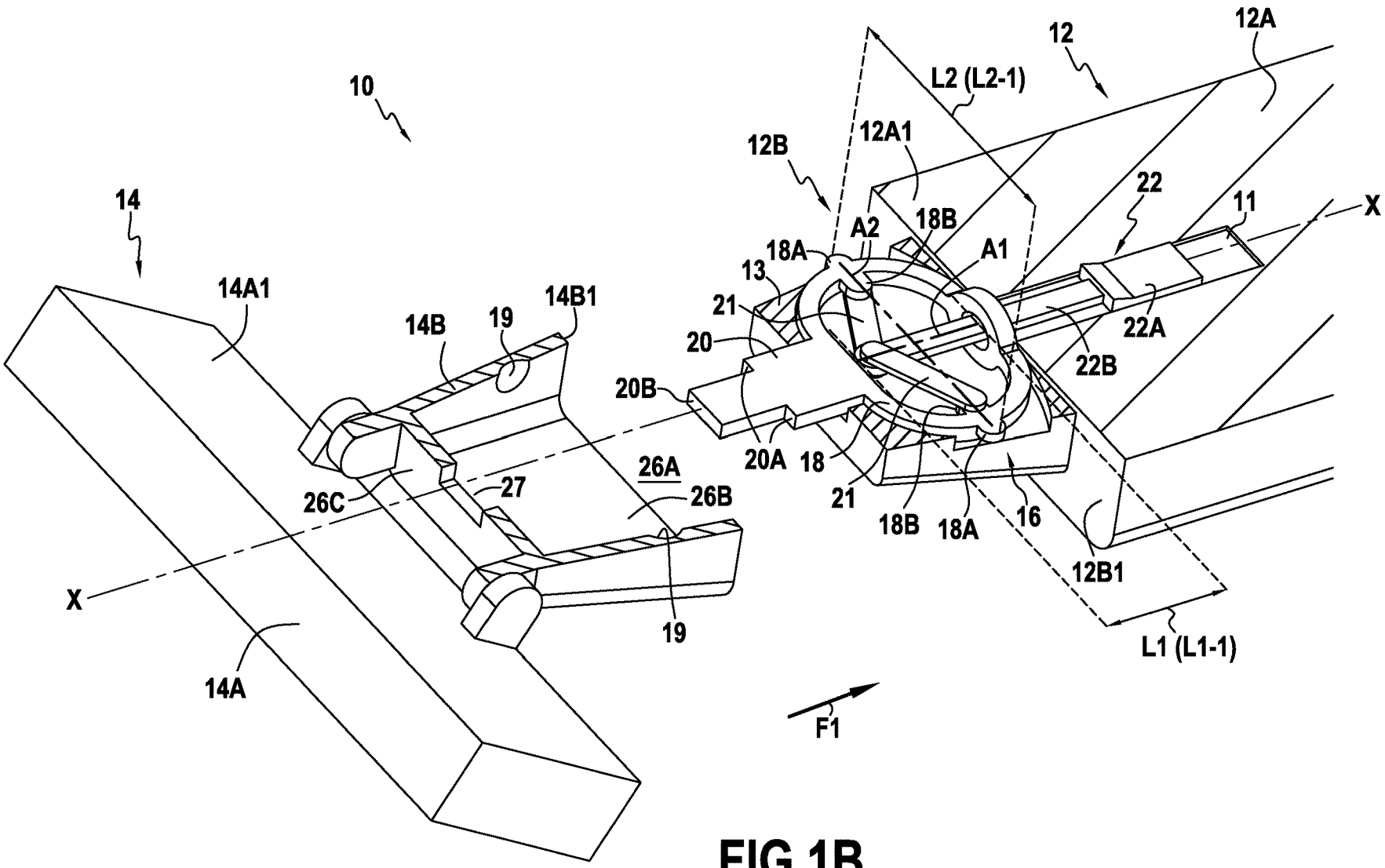
FIG. 1B shows a sectional view in the plane IB of FIG. 1A.
Figure 2A:
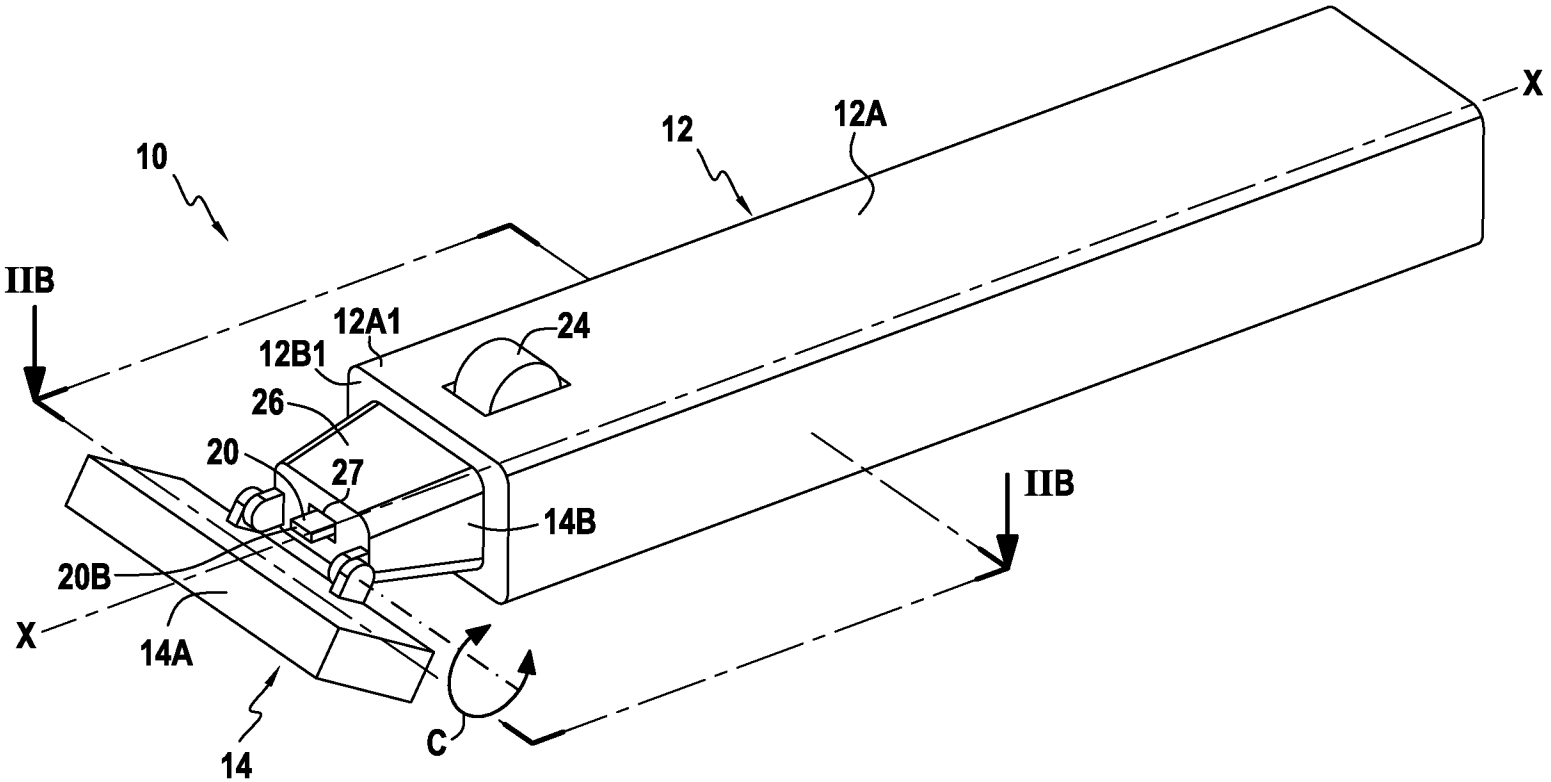
FIG. 2A shows the shaving device of FIG. 1, wherein the removable cartridge is assembled with the handle.
Figure 2B:
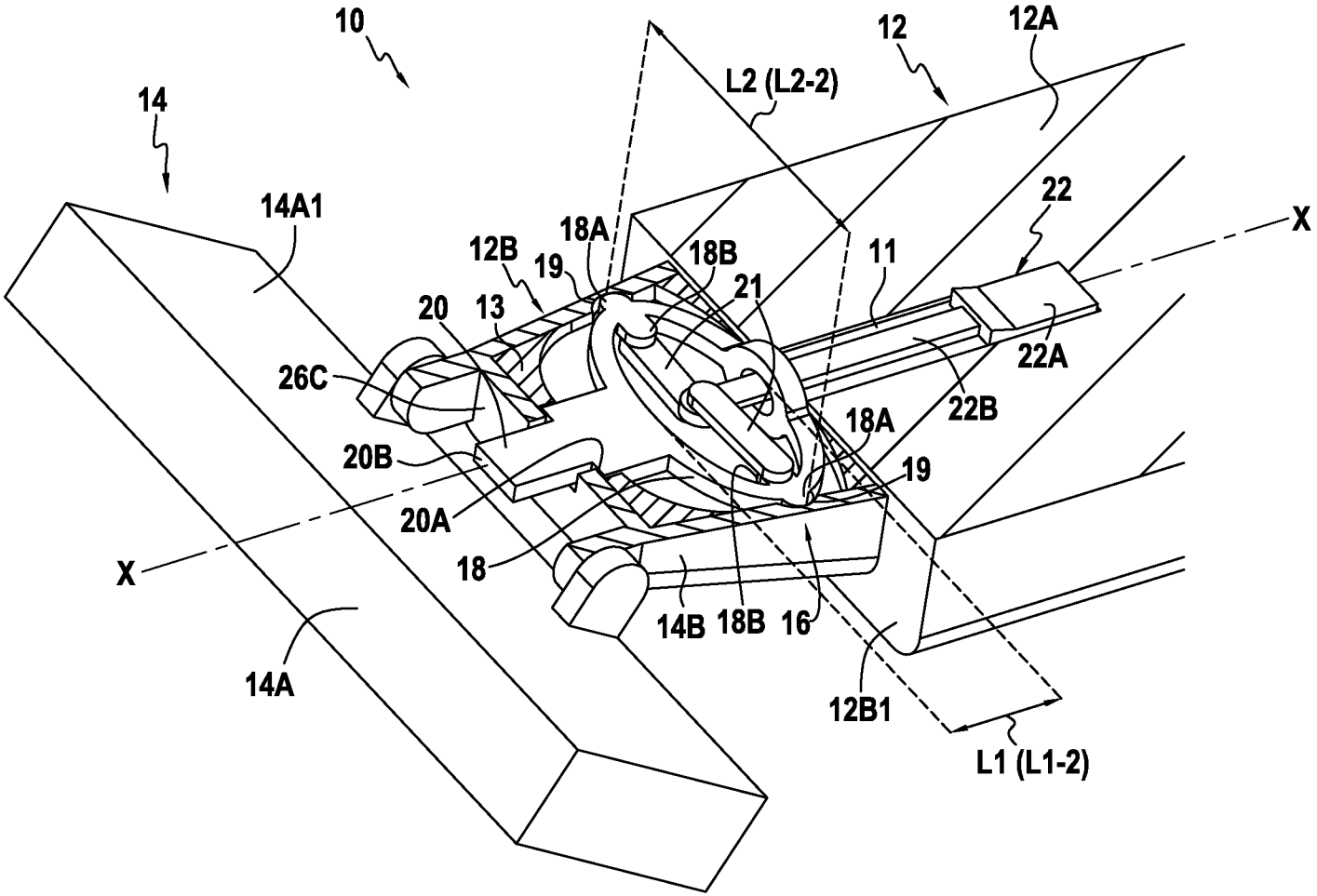
FIG. 2B shows a sectional view in the plane IIB of FIG. 2A.

When assembling the cartridge 14 with the handle 12, the second coupling element 14B is axially moved toward the first coupling portion 12B as shown by the arrow F1 in FIGS. 1A and 1B. When the cartridge 14 is not assembled with the handle 12, as shown in FIGS. 1A and 1B, the annular spring 18 is in a relaxed configuration. In the relaxed configuration, the annular spring 18 may be pre-stressed or not. During the axial movement along the arrow F1 in FIGS. 1A and 1B, the first coupling portion 12B is received within the second coupling portion 14B, the first coupling portion 12B passing through the aperture 26B of the sheath 26. During this axial movement, the second abutment 20B of the pusher 20 may pass through the through hole 27 and face the rear face 14A1 of the shaving head 14A while the transverse wall 26C may cooperate with the first abutment 20A of the pusher 20. Then, continuing the axial movement, the annular spring 18 is radially compressed due to the cooperation of the transverse wall 26C with the first abutment 20A of the pusher 20. During the compression, the annular spring 18 radially expands in a direction perpendicular to the axis X and radially shrinks along the axis X. For example, the lateral wall 26B of the sheath 26 may be flared so that the protrusions 18A may move radially outwardly in a direction perpendicular to the axis X before facing the recesses 19. When the second coupling portion 14B reaches and passes the axial predetermined portion PAP, the recesses 19 may face the protrusions 18A which engage the recesses 19 while the hook 22A, moved axially toward the gripping portion 12A by the axial rod 22 via the arms 21 during the axial compression of the annular spring 18 may engage with the complementary stop (not shown) of the button 24. The backstop mechanism 22 thus locks the auto-tightening spring device 16 in a locking configuration. The cartridge 14 is then assembled with the handle 12, as shown in FIGS. 2A and 2B. When the cartridge 14 is assembled with the handle 12, the annular spring 18 is in a compressed configuration.

The annular shape of annular spring 18 may have a first maximum length L1. (corresponding to the axis A2 in this example) measured parallel to the axis X and a second maximum length L2 (corresponding to the axis A1 in this example) measured perpendicularly to axis X in a plane parallel the annular shape. When comparing FIGS. 1B and 2B, the first maximum length L1-1 in the relaxed configuration may be greater than the first maximum length L1-2 in the compressed configuration while the second maximum length L2-1 in the relaxed configuration may be smaller than the second maximum length L2-2 in the compressed configuration.

The shaving head 14A may be rotatably fixed onto the second coupling portion 14B, for example around an axis perpendicular to the axis X, as shown by the arrow C in FIG. 2A. When rotating, the rear face 14A1 of the shaving head 14A may cooperate with the second abutment 20B of the pusher 20. The pusher 20 may provide a return force opposite to the movement of the shaving head 14A due its coupling with the annular spring 18 and due to the elasticity of the annular spring 18.

For disassembling the cartridge 14 from the handle 12, the button 24 may be actuated in a manner well known by the skilled person in order to release the hook 22A of the backstop mechanism 22. The annular spring 18 may thus relax and push the second coupling portion 14B axially away from the first coupling portion 12B, via the pusher 20.

Although the present disclosure is described with reference to specific examples, it is clear that modifications and changes may be made to these examples without going beyond the general scope as defined by the disclosure. In particular, individual characteristics of the various embodiments shown and/or mentioned may be combined in additional embodiments. Consequently, the description and the drawings should be considered in a sense that is illustrative rather than restrictive.

Additionally, all of the disclosed features of an apparatus may be transposed, alone or in combination, to a method and vice versa.

The invention claimed is:

1. A shaving device, comprising:

a handle and a removable cartridge, the handle comprising a gripping portion extending along an axis and a first coupling portion arranged at an axial end of the gripping portion, the removable cartridge comprising a shaving head and a second coupling portion, wherein:

the first coupling portion and the second coupling portion are configured to be removably coupled together for assembling the removable cartridge with the handle, one of the first coupling portion or the second coupling portion comprises an auto-tightening spring device configured to at least partially deform to lock the first coupling portion with the second coupling portion when the second coupling portion is moved axially toward the gripping portion and cooperates with the first coupling portion, and the auto-tightening spring device comprises an annular spring.

2. The shaving device according to claim 1, wherein the annular spring is configured to expand and to engage with at least one recess of the other of the first or second coupling portion when the second coupling portion is moved axially toward the gripping portion and cooperates with the first coupling portion.

3. The shaving device according to claim 1, wherein the annular spring is configured to radially deform when the second coupling portion is moved axially toward the gripping portion and cooperates with the first coupling portion.

4. The shaving device according to claim 1, wherein the annular spring is configured to adopt a relaxed configuration and a compressed configuration, the annular spring having an annular shape having a first maximum length parallel to the axis and a second maximum length perpendicular to the axis and extending in a plane parallel the annular shape, the first maximum length in the relaxed configuration being greater than the first maximum length in the compressed configuration while the second maximum length in the relaxed configuration is smaller than the second maximum length in the compressed configuration.

5. The shaving device according to claim 1, wherein the annular spring comprises at least one protrusion configured to engage within at least one recess of the other of the first or second coupling portion.

6. The shaving device according to claim 1, wherein the annular spring is coupled with a pusher, the pusher being configured to cooperate with the other of the first or second coupling portion, to move axially and to compress radially the annular spring when the second coupling portion is moved axially toward the gripping portion and cooperates with the first coupling portion.

7. The shaving device according to claim 6, wherein, when the removable cartridge is assembled with the handle, the pusher is configured to cooperate with the shaving head in order to provide a return force opposite to a movement of the shaving head.

8. The shaving device according to claim 6, wherein the pusher and the annular spring are integrally formed as a mono-block component.

9. The shaving device according to claim 1, wherein the auto-tightening spring device comprises a backstop.

10. The shaving device according to claim 9, wherein the backstop comprises a hook configured to move axially when the annular spring of the auto-tightening device is radially deformed.

11. The shaving device according to claim 10, wherein the hook comprises an axial rod, the axial rod being coupled with two diametrically opposed areas of the annular spring disposed respectively on both sides of the axis, via two arms.

12. The shaving device according to claim 9, wherein the backstop and the annular spring of the auto-tightening device are integrally formed as a mono-block component.

13. The shaving device according to claim 9, wherein the backstop is configured to be released.

14. The shaving device of claim 9, wherein the backstop is configured to lock the auto-tightening spring device in a locking configuration when the second coupling portion has passed a predetermined position along the axis with regard to the first coupling portion.

15. The shaving device of claim 9, wherein the backstop comprises a hook.

16. The shaving device according to claim 1, wherein the auto-tightening spring device is at least in part arranged within a housing of the first coupling portion.

17. A shaving device, comprising:

a handle and a removable cartridge, the handle comprising a gripping portion extending along an axis and a first coupling portion arranged at an axial end of the gripping portion; and the removable cartridge comprising a shaving head and a second coupling portion, wherein:

the first coupling portion and the second coupling portion are configured to be removably coupled together for assembling the removable cartridge with the handle, one of the first coupling portion or the second coupling portion comprises an auto-tightening spring device configured to at least partially deform to lock the first coupling portion with the second coupling portion when the second coupling portion is moved axially toward the gripping portion and cooperates with the first coupling portion, and the auto-tightening spring device comprises a part configured to expand and to engage with at least one recess of the other of the first or second coupling portion when the second coupling portion is moved axially toward the gripping portion and cooperates with the first coupling portion.

18. The shaving device of claim 17, wherein the part is a spring.

19. The shaving device of claim 17, wherein the auto-tightening spring device comprises a pusher extending in the direction of the axis, the pusher being integrally formed as a mono-block with the part.

20. A shaving device, comprising:

a handle and a removable cartridge, the handle comprising a gripping portion extending along an axis and a first coupling portion arranged at an axial end of the gripping portion, and the removable cartridge comprising a shaving head and a second coupling portion, wherein:

the first coupling portion and the second coupling portion are configured to be removably coupled together for assembling the removable cartridge with the handle, one of the first coupling portion or the second coupling portion comprises an auto-tightening spring device configured to at least partially deform to lock the first coupling portion with the second coupling portion when the second coupling portion is moved axially toward the gripping portion and cooperates with the first coupling portion, the auto-tightening spring device comprises a backstop configured to lock the auto-tightening spring device in a locking configuration when the second coupling portion has passed a predetermined position along the axis with regard to the first coupling portion, and the backstop and an annular spring of the auto-tightening device are integrally formed as a mono-block component.

* * * * *